US010041344B2

(12) United States Patent
Mitchell

(10) Patent No.: US 10,041,344 B2
(45) Date of Patent: Aug. 7, 2018

(54) DETERMINING PRESSURE WITHIN A SEALED ANNULUS

(71) Applicant: Landmark Graphics Corporation, Houston, TX (US)

(72) Inventor: Robert Mitchell, Lookout Mountain, GA (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 4 days.

(21) Appl. No.: 15/026,204

(22) PCT Filed: Oct. 31, 2013

(86) PCT No.: PCT/US2013/067866
§ 371 (c)(1),
(2) Date: Mar. 30, 2016

(87) PCT Pub. No.: WO2015/065453
PCT Pub. Date: May 7, 2015

(65) Prior Publication Data

US 2016/0245066 A1 Aug. 25, 2016

(51) Int. Cl.

| | |
|---|---|
| ***G06F 17/10*** | (2006.01) |
| ***E21B 47/00*** | (2012.01) |
| ***E21B 47/06*** | (2012.01) |
| ***E21B 33/14*** | (2006.01) |

(52) U.S. Cl.
CPC ..... *E21B 47/0005* (2013.01); *E21B 33/14* (2013.01); *E21B 47/06* (2013.01)

(58) Field of Classification Search
CPC ..... E21B 47/0005; E21B 33/14; E21B 47/06
See application file for complete search history.

(56) References Cited

U.S. PATENT DOCUMENTS

| | | | |
|---|---|---|---|
| 7,542,885 | B1 | 6/2009 | Majumdar |
| 2005/0246151 | A1 | 11/2005 | Difoggio |
| 2008/0060846 | A1 | 3/2008 | Belcher et al. |
| 2009/0194330 | A1 | 8/2009 | Gray |
| 2010/0096138 | A1 | 4/2010 | Hermes et al. |
| 2010/0288507 | A1 | 11/2010 | Duhe et al. |
| 2013/0090854 | A1 | 4/2013 | Rasmus et al. |
| 2013/0118752 | A1 | 5/2013 | Hannegan et al. |

OTHER PUBLICATIONS

A.R. Hasan et al., "Ensuring sustained production by managing annular-pressure buildup," 2009, 2009 SPE Europe/EAGE Annual Conference and Exhibition, 14 pages.*

Juan C. Ramirez et al., "Preventing overpressure hazards from trapped liquids," 2010, Procees Safety Progress, vol. 29, No. 4, pp. 313-317.*

(Continued)

*Primary Examiner* — Kamini S Shah
(74) *Attorney, Agent, or Firm* — Polsinelli PC

(57) ABSTRACT

Systems and methods for determining pressure within a sealed annulus based on the conservation of mass to test the structural integrity of the sealed annulus. The conservation of mass is applied to fluid(s) in a sealed annulus by using the total mass of the fluid(s) in the sealed annulus, instead of volume changes, as the basis for estimating pressure changes due to temperature changes.

19 Claims, 3 Drawing Sheets

(56) References Cited

OTHER PUBLICATIONS

Sudhir R. Brahmbhatt, "Are liquid thermal-relief valves needed?," 1984, Chemical Engineering, May 14, 1984, pp. 69-71.*
Bob Moe et al., "Annular pressure buildup: what it is and what to do about it," Aug. 2000, Deepwater Technologies, pp. 21-23.*
George A. Antaki, "Piping and Pipeline Engineering," Chapter 19 Leak and Pressure Test, 2003, CRC Press, 14 pages.*
MortenA, "How to calculate pressure increase in a closed liquid filled cylinder," 2003, http://www.eng-tips.com/faqs.cfm?fid=224, 2 pages.*
Prex, "Pressure increase due to thermal expansion of a trapped liquid," 2007, http://www.eng-tips.com/faqs.cfm?fid=1339, 2 pages.*
S.E. Norris, "A parallel navier-stokes solver for natural convection and free surface flow," Chapter 4 Solution of the Navier-Stokes Equations, 2000, 32 pages.*
A.S. Halal et al., "Casing design for trapped annular pressure buildup," 1994, SPE Drilling & Completion, Jun. 1994, 8 pages.*
P. Oudeman et al., "Transient behavior of annular pressure build-up in HP/HT wells," 2004, SPE 88735, Society of Petroleum Engineers, pp. 1-10.*
International Search Report and Written Opinion for International Application No. PCT/US13/67866 dated Jul. 24, 2014, (15 pages).
Australia Patent Examination Report No. 1, dated May 2, 2016 for Australian Application No. 2013403958, (4 pages).
Response to Australia Examination Report No. 1 dated May 2, 2016 for Australian Application No. 2013403958 filed on Jun. 28, 2016, (3 pages).
Canada 1st Office Action dated Apr. 25, 2016 for Canadian Application No. 2925857, (6 pages).
Response to Canada 1st Office Action dated Apr. 25, 2016 for Canadian Application No. 2925857 filed on Sep. 27, 2016 (8 pages).
United Kingdom Examination Report dated May 24, 2016 for United Kingdom Application No. GB1605374.6, (3 pages)
Response to United Kingdom Examination Report dated May 24, 2016 for United Kingdom Application No. GB1605374.6 filed on Jun. 30, 2016 (3 pages).
Intellectual Property Office of Singapore Search Report and Written Opinion dated Oct. 17, 2016 for Singapore Application No. 11201602438T, (8 pages).
Determination of the Mechanical Integrity of Injection Wells; United States Environmental Protection Agency, Region 5—Underground Injection Control (UIC) Branch, Regional Guidance #5, Revised Jun. 11, 1998 (25 pages).
Mohd Amid Shoushtari et al., Synergistic Evaluation of Production Tubing Heat Losses and Integrity of Oil Well; Journal of Applied Sciences, Dec. 31, 2012, vol. 12, No. 23, pp. 2484-2488.

* cited by examiner

DETERMINING PRESSURE WITHIN A SEALED ANNULUS

CROSS-REFERENCE TO RELATED APPLICATIONS

This application claims the priority of PCT Patent Application No. PCT/US13/67866, filed on Oct. 31, 2013, which is incorporated herein by reference.

STATEMENT REGARDING FEDERALLY SPONSORED RESEARCH

Not applicable.

FIELD OF THE DISCLOSURE

The present disclosure generally relates to systems and methods for determining pressure within a sealed annulus. More particularly, the present disclosure relates to determining pressure within a sealed annulus based on the conservation of mass to test the structural integrity of the sealed annulus.

BACKGROUND

A natural resource such as oil or gas residing in a subterranean formation can be recovered by drilling a well into the formation. The subterranean formation is usually isolated from other formations using a technique known as cementing. In particular, a well bore is typically drilled down to the subterranean formation while circulating a drilling fluid through the well bore. After the drilling is terminated, a string of pipe (e.g. casing string) is run in the well bore. Primary cementing is then usually performed whereby a cement slurry is pumped down through the casing string and into the annulus between the casing string and the wall of the well bore or another casing string to allow the cement slurry to set into an impermeable cement column and thereby fill a portion of the annulus. Sealing the annulus typically occurs near the end of cementing operations after well completion fluids, such as spacer fluids and cements, are trapped in place to isolate these fluids within the annulus from areas outside the annulus. The annulus is conventionally sealed by closing a valve, energizing a seal, and the like.

After completion of the cementing operations, production of the oil or gas may commence. The oil and gas are produced at the surface after flowing through the casing string. As the oil and gas pass through the casing string, heat may be passed from such fluids through the casing string into the annulus. As a result, thermal expansion of the fluids in the annulus above the cement column causes an increase in pressure within the annulus also known as annulus pressure buildup. Annulus pressure buildup typically occurs because the annulus is sealed and its volume is fixed. Annulus pressure buildup may cause damage to the well bore such as damage to the cement sheath, the casing, tubulars, and other equipment. In addition, annulus pressure buildup makes proper casing design difficult if not impossible. Because the fluid pressures may be different in the annulus for each well bore, use of a standard casing design may not be practical. In order to control annulus pressure buildup, conventional methods circulate gas into place during cementing operations. Because the gas is mobile, it is difficult to place the gas in the proper location and, at the same time, control the fluid pressure in the annulus. If, for example, the gas is placed too far below the top of the annulus, the rising gas will increase the pressure in the annulus.

In order to maintain a safe and acceptable pressure within the sealed annulus, the pressure within the sealed annulus must be calculated within some level of certainty. Some methods have been proposed for determining annulus pressure buildup, which are based on volume changes. One method, for example, calculates the fluid volume change $\Delta V_f$ using the fluid bulk modulus K and the volume coefficient of thermal expansion β according to equation (1):

$$\Delta V_f = V_f\left(\beta\Delta T - \frac{\Delta P}{K}\right) \tag{1}$$

where $V_f$ is the fluid volume, ΔT is the temperature change, and ΔP is the pressure change. Equation (1) uses parameters that are derived from the PVT (pressure-volume-temperature) behavior of the fluid in the sealed annulus, not properties that are directly measured. Because equation (1) applies to the entire annulus, the values of K and β represent some type of average value that must be properly chosen to get the correct answer. And, equation (1) may be used to calculate the pressure within the sealed annulus within some level of certainty only for sufficiently small values of ΔT and ΔP. Another method directly uses the PVT behavior of the fluid and integrates the volume change over the length of the annulus to calculate the fluid volume change $\Delta V_f$ according to equation (2):

$$\Delta V_f = -\int_{s_0}^{s_1} \frac{\Delta\rho}{\rho + \Delta\rho} A\, ds \tag{2}$$

where ρ is the initial density, βρ is the change in density, A is the annulus cross-sectional area and s is the axial coordinate (measured depth) of the annulus. The assumption in equation (2) is that the temperature and pressure are functions of s, and that density is calculated as a function of temperature and pressure, so that the integrand of equation (2) also varies with s. In both methods represented by equations (1) and (2), the casing volume change $\Delta V_c$ is calculated as a function of pressure and temperature using Lame's equation from conventional elasticity theory. The annulus pressure buildup ΔPb for either the method represented by equation (1) or the method represented by equation (2) is thus, determined when:

$$\Delta V_f = \Delta V_c \tag{3}$$

The disadvantage of both methods is apparent when multiple fluids are present in the sealed annulus. A gas, for example, may be introduced at the base of the annulus, which later migrates to the top of the annulus. This gas cannot be characterized by its volume according to the foregoing methods because its volume varies with the pressure and temperature. In other words, gas at the base of the annulus will usually have a higher temperature and pressure than gas at the top of the annulus.

BRIEF DESCRIPTION OF THE DRAWINGS

The present disclosure is described below with references to the accompanying drawings in which like elements are referenced with like reference numerals, and in which.

DETAILED DESCRIPTION OF THE PREFERRED EMBODIMENTS

Figure 1:
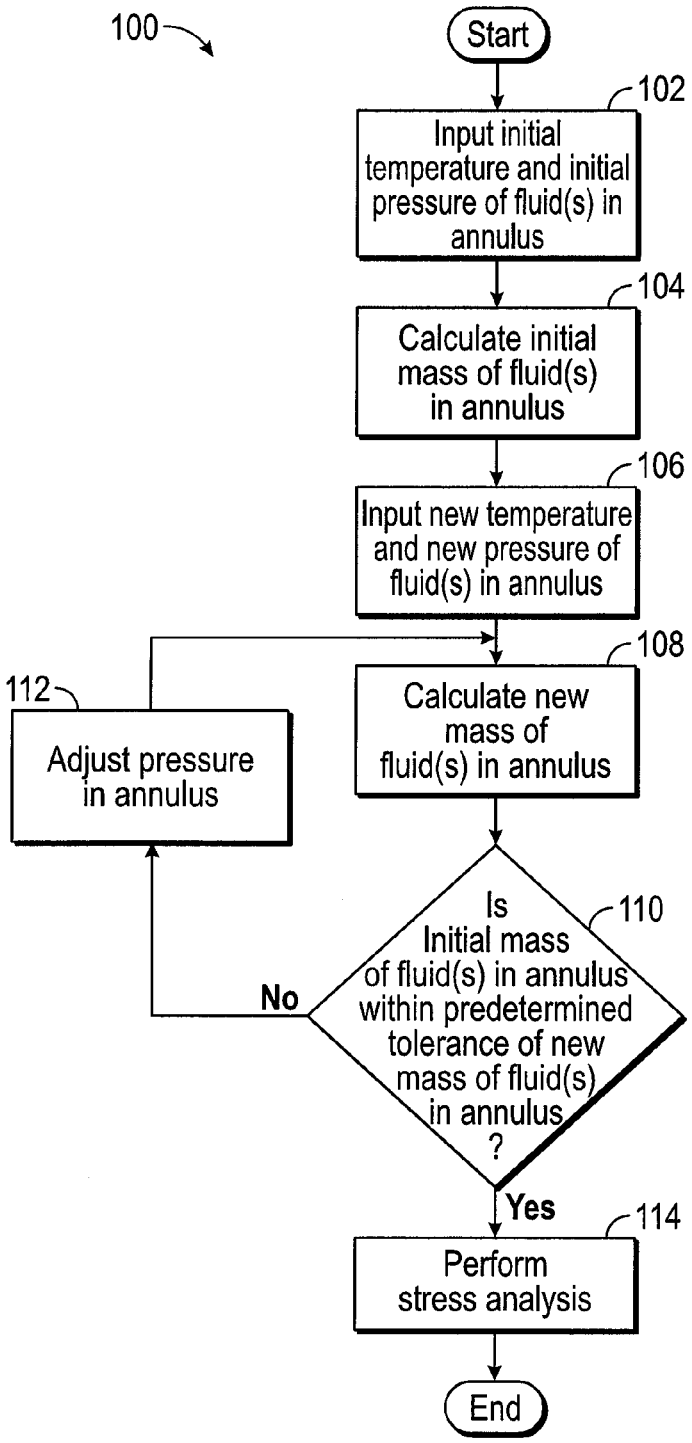
FIG. 1 is a flow diagram illustrating one embodiment of a method for implementing the present disclosure.

The present disclosure therefore, overcomes one or more deficiencies in the prior art by providing systems and methods for determining pressure within a sealed annulus based on the conservation of mass to test the structural integrity of the sealed annulus.

In one embodiment, the present disclosure includes a method for determining pressure within a sealed annulus to test the sealed annulus for structural integrity, which comprises: a) calculating an initial mass of each fluid in the sealed annulus based on an initial temperature and an initial pressure for each fluid; b) calculating a new mass of each fluid in the sealed annulus based on a new temperature and a new pressure for each fluid; and c) determining the pressure within the sealed annulus using a computer processor by comparing a total for the initial mass of each fluid in the sealed annulus and a total for the new mass of each fluid in the sealed annulus.

In another embodiment, the present disclosure includes a non-transitory program carrier device tangibly carrying computer executable instructions for determining pressure within a sealed annulus to test the sealed annulus for structural integrity, the instructions being executable to implement: a) calculating an initial mass of each fluid in the sealed annulus based on an initial temperature and an initial pressure for each fluid; b) calculating a new mass of each fluid in the sealed annulus based on a new temperature and a new pressure for each fluid; and c) determining the pressure within the sealed annulus by comparing a total for the initial mass of each fluid in the sealed annulus and a total for the new mass of each fluid in the sealed annulus.

In another embodiment, the present disclosure includes a non-transitory program carrier device tangibly carrying computer executable instructions for determining pressure within a sealed annulus to test the sealed annulus for structural integrity, the instructions being executable to implement: a) calculating an initial mass of each fluid in the sealed annulus based on an initial temperature and an initial pressure for each fluid; b) calculating a new mass of each fluid in the sealed annulus based on a new temperature and a new pressure for each fluid; c) determining the pressure within the sealed annulus by comparing a total for the initial mass of each fluid in the sealed annulus and a total for the new mass of each fluid in the sealed annulus; d) adjusting the new pressure within the sealed annulus based on the total for the initial mass of each fluid in the sealed annulus not being within a predetermined tolerance of the total for the new mass of each fluid in the sealed annulus; and e) repeating steps b)-d).

The subject matter of the present disclosure is described with specificity, however, the description itself is not intended to limit the scope of the disclosure. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the present disclosure may be applied in the oil and gas industry, it is not limited thereto and may also be applied in other industries to achieve similar results.

Method Description

Referring now to FIG. 1, a flow diagram of one embodiment of a method 100 for implementing the present disclosure is illustrated. The method 100 is based on the conservation of mass of the fluid(s) in the sealed annulus, which is represented by equation (4):

$$M = \int_{s_0}^{s_1} \rho_{init} A ds = \int_{s_0}^{s_1} \rho_{new}(A + \Delta A)\, ds \tag{4}$$

where $\rho_{init}$ is the initial density of the fluid, $\rho_{new}$ is the new density of the fluid, A is the initial cross-sectional area, and $\Delta A$ is the additional cross-sectional area due to temperature and pressure changes. The integration limits in equation (4), and its components in equation (5) and equation (8), are from the base of each fluid in the sealed annulus $s_0$ to the top of each fluid in the sealed annulus $s_1$. These depths are either specified in the casing design or estimated during installation of the fluid(s) in the field using circulated volumes during the cementing procedure. The method 100 therefore, determines pressure in a sealed annulus by using the total mass of the fluid(s) in the sealed annulus, instead of volume changes, as the basis for estimating pressure changes due to temperature changes.

Figure 3:
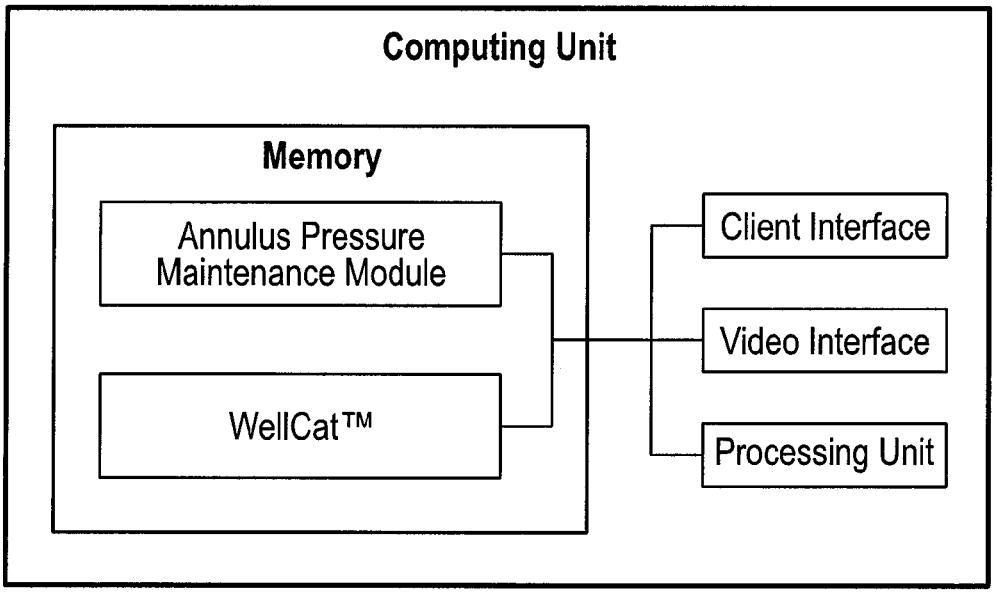
FIG. 3 is a block diagram illustrating one embodiment of a computer system for implementing the present disclosure.

In step 102, an initial temperature and an initial pressure are automatically input for the fluid(s) in the sealed annulus or they may be manually input using the client interface and/or the video interface described further in reference to FIG. 3 The initial temperature and the initial pressure for the fluid(s) in the sealed annulus are measured before the annulus is sealed.

In step 104, an initial mass of the fluid(s) in the sealed annulus is calculated using the initial temperature and the initial pressure from step 102 and equation (5) for a single fluid:

$$M_{init} = \int_{s_0}^{s_1} \rho_{init} A\, ds \tag{5}$$

or equation (6) for multiple fluids:

$$M_{init}^{k} = \int_{s_{k-1}}^{s_k} \rho_{init}^{k} A\, ds,\ k = 1, N \tag{6}$$

where N is the number of fluids in the sealed annulus and k represents the fluid, which has an initial density $\rho_{init}^{k}$ between depths $s_{k-1}$ and $s_k$. The total initial mass of the multiple fluids in the sealed annulus is represented by equation (7):

$$M_{init} = \sum_{k=1}^{N} M_{init}^{k} \tag{7}$$

The initial density for each fluid in the sealed annulus is calculated from the initial temperature and the initial pressure for each fluid using techniques well known in the art. The initial cross-sectional area for each fluid in the sealed annulus is defined by the well completion casing design and is specified as a function of depth s.

In step 106, a new temperature and a new pressure are automatically input for the fluid(s) in the sealed annulus or they may be manually input using the client interface and/or the video interface described further in reference to FIG. 3. Due to drilling ahead in the well bore, or other conditions described further in reference to step 112, the temperature of the fluid(s) in the sealed annulus may increase, causing the fluid(s) to expand in the sealed annulus, or decrease, causing the fluid(s) to contract in the sealed annulus. As a result, each fluid may have a new density $\rho_{new}$ and an additional cross-sectional area $\Delta A$.

In step 108, a new mass of the fluid(s) in the sealed annulus is calculated using the new temperature and the new pressure from step 106 and equation (8) for a single fluid:

$$M_{new} = \int_{s_0}^{s_1} \rho_{new}(A + \Delta A)\, ds \tag{8}$$

or equation (9) for multiple fluids:

$$M_{new}^{k} = \int_{\hat{s}_{k-1}}^{\hat{s}_k} \rho_{new}^{k}(A + \Delta A)\, ds \tag{9}$$

The new density $\rho_{new}$ for each fluid in the sealed annulus is calculated from the new temperature and the new pressure for each fluid using techniques well known in the art. The additional cross-sectional area $\Delta A$ for each fluid in the sealed annulus is determined by any well known elasticity theory, for example, Lame's solution for thick walled pipes. The total new mass of the multiple fluids in the sealed annulus is represented by equation (10):

$$M_{new} = \sum_{k=1}^{N} M_{new}^{k} \tag{10}$$

The calculation of the final mass for multiple fluids in a sealed annulus may need to address the fact that the initial and final measured depths of each fluid in the sealed annulus may not be the same. This is particularly true when gases are present in the sealed annulus. One approach is to calculate the depths for each fluid so that the final mass equals the initial mass. The first fluid (k=1) mass starts at the known depth $s_0$, which determines the new depth $\hat{s}_1$ so that $M_{init}^{1}=M_{final}^{1}$. In general, $\hat{s}_1 \neq s_1$. The next fluid (k=2) mass integrates from $\hat{s}_1$ to $\hat{s}_2$ so that $M_{init}^{2}=M_{final}^{2}$. Because the sealed annulus has a fixed depth, the last depth is $s_n$, which may not correspond to $\hat{s}_n$ and means the mass will be either too large ($s_n > \hat{s}_n$) or too small ($s_n < \hat{s}_n$) as demonstrated by the example illustrated in FIG. 2.

In step 110, the method 100 determines if the initial mass of the fluid(s) in the sealed annulus is within a predetermined tolerance (e.g. 0.01%) of the new mass of the fluid(s) in the sealed annulus. In other words, the initial mass of the fluid(s) in the sealed annulus is within a predetermined tolerance of the new mass of the fluid(s) in the sealed annulus when the annulus pressure build-up $\Delta Pb$ makes $|M_{init}-M_{new}|$ sufficiently near zero for a single fluid and $|M_{init}^{N}-M_{new}^{N}|$ sufficiently near zero for multiple fluids. If the initial mass of the fluid(s) in the sealed annulus is within a predetermined tolerance of the new mass of the fluid(s) in the sealed annulus, then the method 100 proceeds to step 114. If the initial mass of the fluid(s) in the sealed annulus is not within a predetermined tolerance of the new mass of the fluid(s) in the sealed annulus, then the method 100 proceeds to step 112.

In step 112, the pressure in the sealed annulus is adjusted using techniques well known in the art to bring the initial mass of the fluid(s) in the sealed annulus within the predetermined tolerance of the new mass of the fluid(s) in the sealed annulus. In this manner, the structural integrity and design of any casing surrounding the sealed annulus may be validated. If, for example, $M_{new}<M_{init}$, then the pressure in the sealed annulus needs to be increased, which will increase the new temperature, the new density $\rho_{new}$ and the additional cross-sectional area $\Delta A$ of the fluid(s) in the sealed annulus. Conversely, if $M_{new}>M_{init}$, then the pressure in the sealed annulus needs to be decreased, which will decrease the new temperature, the new density $\rho_{new}$ and the additional cross-sectional area $\Delta A$ of the fluid(s) in the sealed annulus. The method 100 then returns to step 108 using the new temperature and the new pressure to calculate the new density $\rho_{new}$ and the new values for the additional cross-sectional area $\Delta A$ of the fluid(s) in the sealed annulus.

In step 114, a stress analysis is performed on the casing using techniques well known in the art. Because the conventional volume changes do not address the final pressure distribution in the sealed annulus, the new density, pressure and temperature that result from satisfying the conditions of step 110 may be used to determine the final pressure distribution in the sealed annulus by solving the static equilibrium equation (11) for the fluid(s) in the sealed annulus:

$$\frac{dP}{ds} = \rho[P, T(s)]g\cos\phi(s) \tag{11}$$

where the temperature is given as a function of the axial coordinate s (measured depth). When the conditions of step 110 are satisfied, the new pressure should also satisfy equation (11), but with a new temperature distribution and with the pressure incremented by $\Delta P_b$. For some liquids, density may not be very sensitive to pressure and temperature, so the initial pressure distribution may be acceptable. If, however, there is gas in the sealed annulus, the initial pressure distribution will not generally approximate the final pressure distribution. To properly calculate the equations in step 108, it may be necessary to simultaneously calculate equation (11). Well known numerical methods for calculating equation (11) can also easily calculate the equations in step 108.

Because gas is much more compressible than other typical annulus fluids and greater volume change can be accomplished with a smaller pressure change, an annulus gas cap is often specified to minimize annulus pressure build-up. In general, the gas cannot always be placed at the top of the annulus. Eventually, however, the gas will migrate to the top of the annulus. There is a pressure change associated with this movement called the u-tube effect. In a rigid sealed container with an incompressible fluid and a gas bubble at the bottom, movement of the bubble upward will increase the pressure in the container. The reason for this behavior is that the gas pressure is proportional to the gas volume, and the gas volume is fixed by the rigid container and the incompressible fluid. Assume, for example, that the pressure at the top of the container is 10 psi and the pressure at the bottom is 100 psi, with the bubble at the bottom. If the bubble rises to the top, then its volume cannot change so its pressure remains 100 psi. Because the incompressible fluid added 90 psi due to its weight, the pressure at the bottom of the container is now 190 psi. To deal with this problem, annulus pressure buildup must be formulated in terms of the mass of the fluids because the mass does not vary with pressure and temperature. Using the method 100, the initial mass of the fluid(s) in a sealed annulus can be accurately estimated with the gas at some depth below the top of the annulus. The gas can then move to the top of the annulus. Because the mass is invariant, the fluid masses do not change, only their position changes. A pressure increment may be necessary to satisfy the mass conservation principal, and this pressure is the u-tube pressure for this annulus. The method 100 thus, more efficiently determines the pressure in a sealed annulus, which is necessary for the stress analysis of casing designs. The method 100 also allows the calculation of u-tube pressures caused by the movement of gas pockets within the sealed annulus, which is necessary for government approval of a deep water casing designs.

EXAMPLE

Figure 2:
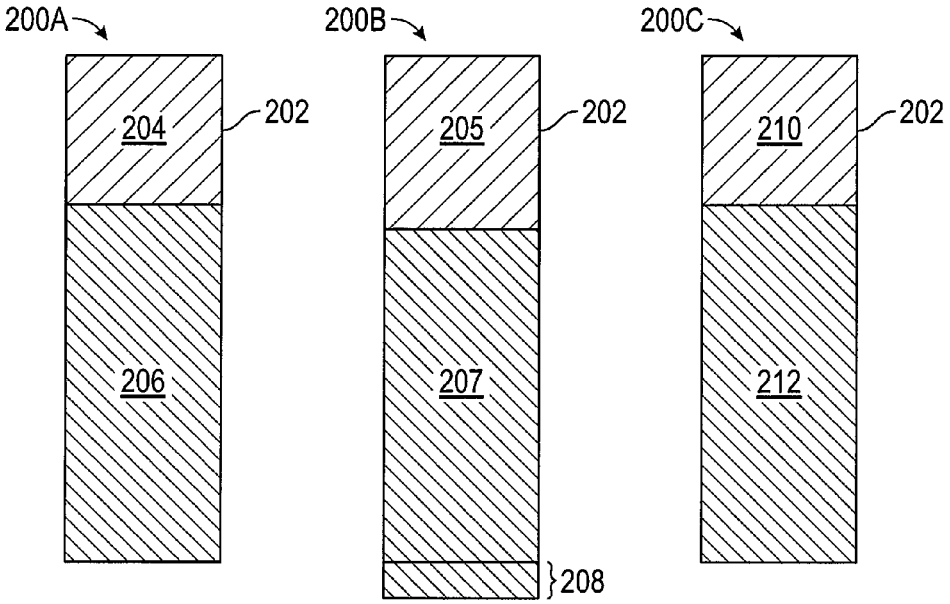
FIG. 2 is a series of schematic displays of different masses for respective fluids in a sealed annulus illustrating the different masses for the respective fluids as pressure within the sealed annulus is adjusted according to the method in FIG. 1.

Referring now to FIG. 2, a series of schematic displays of different masses for respective fluids in a sealed annulus illustrate the different masses for the respective fluids as pressure within the sealed annulus is adjusted according to the method 100 in FIG. 1. The same two fluids are used in each schematic display. The schematic display 200A illustrates the sealed annulus 202, a first fluid initial volume 204 and a second fluid initial volume 206, the initial masses of which are calculated using equation (6) in step 104 of FIG. 1. The schematic display 200B illustrates the sealed annulus 202, a first fluid new volume 205 and a second fluid new volume 207, the new masses of which are calculated using equation (9) in step 108 of FIG. 1 after an increase in pressure in the sealed annulus 202 due to drilling conditions. The new mass of the first fluid new volume 205 is equal to the initial mass of the first fluid initial volume 204, however, the new mass of the second fluid new volume 207 is less than the initial mass of second fluid initial volume 206, which results in a loss of mass 208 in the second fluid initial volume 206 when compared to the second fluid new volume 207. Because the total mass of the first fluid new volume 205 and the second fluid new volume 207 is not within a predetermined tolerance of the first fluid initial volume 204 and the second fluid initial volume 206, the pressure in the sealed annulus must be adjusted according to step 112 in FIG. 1. The schematic display 200C illustrates the sealed annulus 202, another first fluid new volume 210 and another second fluid new volume 212, the new masses of which are calculated using equation (9) in step 108 of FIG. 1 after a change in pressure in the sealed annulus 202 according to step 112 in FIG. 1. The another first fluid new volume 210 and the another second fluid new volume 212 are now within a predetermined tolerance of the first fluid initial volume 204 and the second fluid initial volume 206.

System Description

The present disclosure may be implemented through a computer-executable program of instructions, such as program modules, generally referred to as software applications or application programs executed by a computer. The software may include, for example, routines, programs, objects, components and data structures that perform particular tasks or implement particular abstract data types. The software forms an interface to allow a computer to react according to a source of input. WellCat™, which is a commercial software application marketed by Landmark Graphics Corporation, may be used as an interface application to implement the present disclosure. The software may also cooperate with other code segments to initiate a variety of tasks in response to data received in conjunction with the source of the received data. The software may be stored and/or carried on any variety of memory such as CD-ROM, magnetic disk, bubble memory and semiconductor memory (e.g. various types of RAM or ROM). Furthermore, the software and its results may be transmitted over a variety of carrier media such as optical fiber, metallic wire and/or through any of a variety of networks, such as the Internet.

Moreover, those skilled in the art will appreciate that the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof, in a computer system or other processing system.

Referring now to FIG. 3, a block diagram illustrates one embodiment of a system for implementing the present disclosure on a computer. The system includes a computing unit, sometimes referred to as a computing system, which contains memory, application programs, a client interface, a video interface, and a processing unit. The computing unit is only one example of a suitable computing environment and is not intended to suggest any limitation as to the scope of use or functionality of the disclosure.

The memory primarily stores the application programs, which may also be described as program modules containing computer-executable instructions, executed by the computing unit for implementing the present disclosure described herein and illustrated in FIGS. 1-2. The memory therefore, includes an annulus pressure maintenance module, which enables steps 102-112 described in reference to FIG. 1. The annulus pressure maintenance module may integrate functionality from the remaining application programs illustrated in FIG. 3. In particular, WellCat™ may be used as an interface application to perform the stress analysis in step 114 of FIG. 1. Although WellCat™ may be used as interface application, other interface applications may be used, instead, or the annulus pressure maintenance module may be used as a stand-alone application.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to, and/or presently being operated on, the processing unit. By way of example, and not limitation, the computing unit includes an operating system, application programs, other program modules, and program data.

The components shown in the memory may also be included in other removable/nonremovable, volatile/nonvolatile computer storage media or they may be implemented in the computing unit through an application program interface ("API") or cloud computing, which may reside on a separate computing unit connected through a computer system or network. For example only, a hard disk drive may read from or write to nonremovable, nonvolatile magnetic media, a magnetic disk drive may read from or write to a removable, nonvolatile magnetic disk, and an optical disk drive may read from or write to a removable, nonvolatile optical disk such as a CD ROM or other optical media. Other removable/nonremovable, volatile/nonvolatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like. These and other input devices are often connected to the processing unit through the client interface that is coupled to a system bus, but may be connected by other interface and bus structures, such as a parallel port or a universal serial bus (USB).

A monitor or other type of display device may be connected to the system bus via an interface, such as a video interface. A graphical user interface ("GUI") may also be used with the video interface to receive instructions from the client interface and transmit instructions to the processing unit. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A method for determining pressure within a sealed annulus to test the sealed annulus for structural integrity, which comprises:

a) calculating an initial mass of each fluid in the sealed annulus based on an initial temperature and an initial pressure for each fluid;

b) calculating a new mass of each fluid in the sealed annulus based on a new temperature and a new pressure for each fluid;

c) determining the pressure within the sealed annulus using a computer processor by comparing a total for the initial mass of each fluid in the sealed annulus and a total for the new mass of each fluid in the sealed annulus;

d) adjusting the new pressure within the sealed annulus based on the total for the initial mass of each fluid in the sealed annulus not being within a predetermined tolerance of the total for the new mass of each fluid in the sealed annulus;

e) repeating steps b)-d) until the total for the initial mass of each fluid in the sealed annulus is within the predetermined tolerance of the total for the new mass of each fluid in the sealed annulus; and f) controlling, after the total initial mass of each fluid in the sealed annulus is within the predetermined tolerance of the total for the new mass of each fluid in the sealed annulus, an actual annulus pressure based on the new pressure by at least one of circulating gas in an actual annulus during cementing operations or selecting a casing design and deploying said casing.

2. The method of claim 1, wherein the predetermined tolerance is 0.01%.

3. The method of claim 1, wherein the pressure within the sealed annulus is increased when the total for the initial mass of each fluid in the sealed annulus is greater than the total for the new mass of each fluid in the sealed annulus.

4. The method of claim 1, wherein the pressure within the sealed annulus is decreased when the total for the initial mass of each fluid in the sealed annulus is less than the total for the new mass of each fluid in the sealed annulus.

5. The method of claim 1, wherein the initial temperature and the initial pressure for each fluid are used to calculate an initial density for each fluid and the new temperature and the new pressure for each fluid are used to calculate a new density for each fluid.

6. The method of claim 1, wherein the sealed annulus includes multiple fluids comprising a liquid and a gas.

7. The method of claim 6, wherein the initial mass of the gas is calculated when the gas is positioned at a base of the sealed annulus and the new mass of the gas is calculated when the gas is positioned at a top of the sealed annulus.

8. The method of claim 1 wherein the selecting casing design comprises selecting an annulus cross sectional area.

9. A non-transitory program carrier device tangibly carrying computer executable instructions for determining pressure within a sealed annulus to test the sealed annulus for structural integrity, the instructions being executable to implement:

a) calculating an initial mass of each fluid in the sealed annulus based on an initial temperature and an initial pressure for each fluid;

b) calculating a new mass of each fluid in the sealed annulus based on a new temperature and a new pressure for each fluid;

c) determining the pressure within the sealed annulus by comparing a total for the initial mass of each fluid in the sealed annulus and a total for the new mass of each fluid in the sealed annulus;

d) adjusting the new pressure within the sealed annulus based on the total for the initial mass of each fluid in the sealed annulus not being within a predetermined tolerance of the total for the new mass of each fluid in the sealed annulus;

e) repeating steps b)-d) until the total for the initial mass of each fluid in the sealed annulus is within the predetermined tolerance of the total for the new mass of each fluid in the sealed annulus; and f) controlling, after the total initial mass of each fluid in the sealed annulus is within the predetermined tolerance of the total for the new mass of each fluid in the sealed annulus, an actual annulus pressure based on the new pressure by at least one of circulating gas in an actual annulus during cementing operations or selecting a casing design and deploying said casing.

10. The program carrier device of claim 9, wherein the predetermined tolerance is 0.01%.

11. The program carrier device of claim 10, wherein the pressure within the sealed annulus is increased when the total for the initial mass of each fluid in the sealed annulus is greater than the total for the new mass of each fluid in the sealed annulus.

12. The program carrier device of claim 10, wherein the pressure within the sealed annulus is decreased when the total for the initial mass of each fluid in the sealed annulus is less than the total for the new mass of each fluid in the sealed annulus.

13. The program carrier device of claim 9, wherein the initial temperature and the initial pressure for each fluid are used to calculate an initial density for each fluid and the new temperature and the new pressure for each fluid are used to calculate a new density for each fluid.

14. The program carrier device of claim 9, wherein the sealed annulus includes multiple fluids comprising a liquid and a gas.

15. The program carrier device of claim 14, wherein the initial mass of the gas is calculated when the gas is positioned at a base of the sealed annulus and the new mass of the gas is calculated when the gas is positioned at a top of the sealed annulus.

16. A non-transitory program carrier device tangibly carrying computer executable instructions for determining pressure within a sealed annulus, the instructions being executable to implement:

a) calculating an initial mass of each fluid in the sealed annulus based on an initial temperature and an initial pressure for each fluid;

b) calculating a new mass of each fluid in the sealed annulus based on a new temperature and a new pressure for each fluid;

c) determining the pressure within the sealed annulus by comparing a total for the initial mass of each fluid in the sealed annulus and a total for the new mass of each fluid in the sealed annulus;

d) adjusting the new pressure within the sealed annulus based on the total for the initial mass of each fluid in the sealed annulus not being within a predetermined tolerance of the total for the new mass of each fluid in the sealed annulus;

e) repeating steps b)-d); and f) controlling, after the total initial mass of each fluid in the sealed annulus is within the predetermined tolerance of the total for the new mass of each fluid in the sealed annulus, an actual annulus pressure based on the new pressure by at least one of circulating gas in an actual annulus during cementing operations or selecting a casing design and deploying said casing.

17. The program carrier device of claim 16, wherein the predetermined tolerance is 0.01%.

18. The program carrier device of claim 16, wherein the sealed annulus includes multiple fluids comprising a liquid and a gas.

19. The program carrier device of claim 16, wherein the initial mass of the gas is calculated when the gas is positioned at a base of the sealed annulus and the new mass of the gas is calculated when the gas is positioned at a top of the sealed annulus.

* * * * *